US005451120A

United States Patent [19]

Martinez-Gonzalez

[11] Patent Number: 5,451,120

[45] Date of Patent: Sep. 19, 1995

[54] EARTH REINFORCEMENT AND EMBANKMENT BUILDING SYSTEMS

[75] Inventor: Hector S. Martinez-Gonzalez, Nuevo Leon, Mexico

[73] Assignee: Planobra, S.A. DE C.V., Mexico

[21] Appl. No.: 806,331

[22] Filed: Dec. 13, 1991

[51] Int. Cl.[6] ..... E02D 29/02

[52] U.S. Cl. ..... 405/262; 405/284; 405/286

[58] Field of Search ..... 405/262, 284, 286, 258, 405/285

[56] References Cited

U.S. PATENT DOCUMENTS

| | | | |
|---|---|---|---|
| 4,067,166 | 1/1978 | Sheahan | 405/284 X |
| 4,834,584 | 5/1989 | Hilfiker | 405/262 |
| 4,929,125 | 5/1990 | Hilfiker | 405/262 |
| 4,952,098 | 8/1990 | Grayson et al. | 405/262 |
| 4,968,186 | 11/1990 | Ogorchock | 405/262 |
| 4,993,879 | 2/1991 | Hilfiker | 405/262 |

*Primary Examiner*—Dennis L. Taylor

*Attorney, Agent, or Firm*—Laurence R. Brown

[57] ABSTRACT

This invention provides improved embankment construction systems for earth reinforcement. Meshing is attached to concrete slab walls by trusses for supporting earth deposits between slab walls to build embankments from alternating earth and meshes laterally disposed along the slabs.

1 Claim, 4 Drawing Sheets

EARTH REINFORCEMENT AND EMBANKMENT BUILDING SYSTEMS

SUMMARY OF THE INVENTION

This invention relates to improvement in earth reinforcement and embankment building systems, and more specifically to a combination of lateral slabs, that, with anchors and salients, join trusses to meshes, by means of tie rods. An internal deposit between slab walls forms embankments with alternating meshes and earth.

BACKGROUND OF THE INVENTION

For years the construction industry for the construction of embankments and highways has encountered an erosion problem. Erosion caused first in laterals, and then in the rest of the embankment destroys the roads and highways. This problem increases with demand for the construction of under/over passes, or ramps at different levels than the normal level of the land they are built on.

In the past, some experts on the subject have tried to solve this problem using laterals and elements that work as a resistance structure, with the purpose of avoiding the embankment and foundation's erosion and destruction. The use of lateral elements and bands that are laid out between the different filling layers however are extremely expensive and though the bands support the laterals, they always present the possibility that in time or with excess humidity, they could erode and might allow the laterals to collapse. On the other hand, the cost of the known systems are far higher than the cost of the present invention. Therefore the prior art has not provided a permanent solution to the problem, since eventually as result of humidity and water penetration, prior art structures need to be checked and repaired while suspending vehicle flow on the section of the highway that is being repaired at high financial cost.

So, the main purpose of this invention, is to provide a safe system once it is set, resulting in an advantage to the known systems, since the lateral slabs and the metallic structure are joined so firmly that dismemberment is unlikely. Furthermore, a metallic anticorrosive mesh allows the converting of the different layers of the embankment into an almost monolitic body with the slabs and structures, having enough capacity to indefinitely bear the vibration load and weight of the vehicles that pass over them.

DETAILED DESCRIPTION OF THE INVENTION

Figure 1:
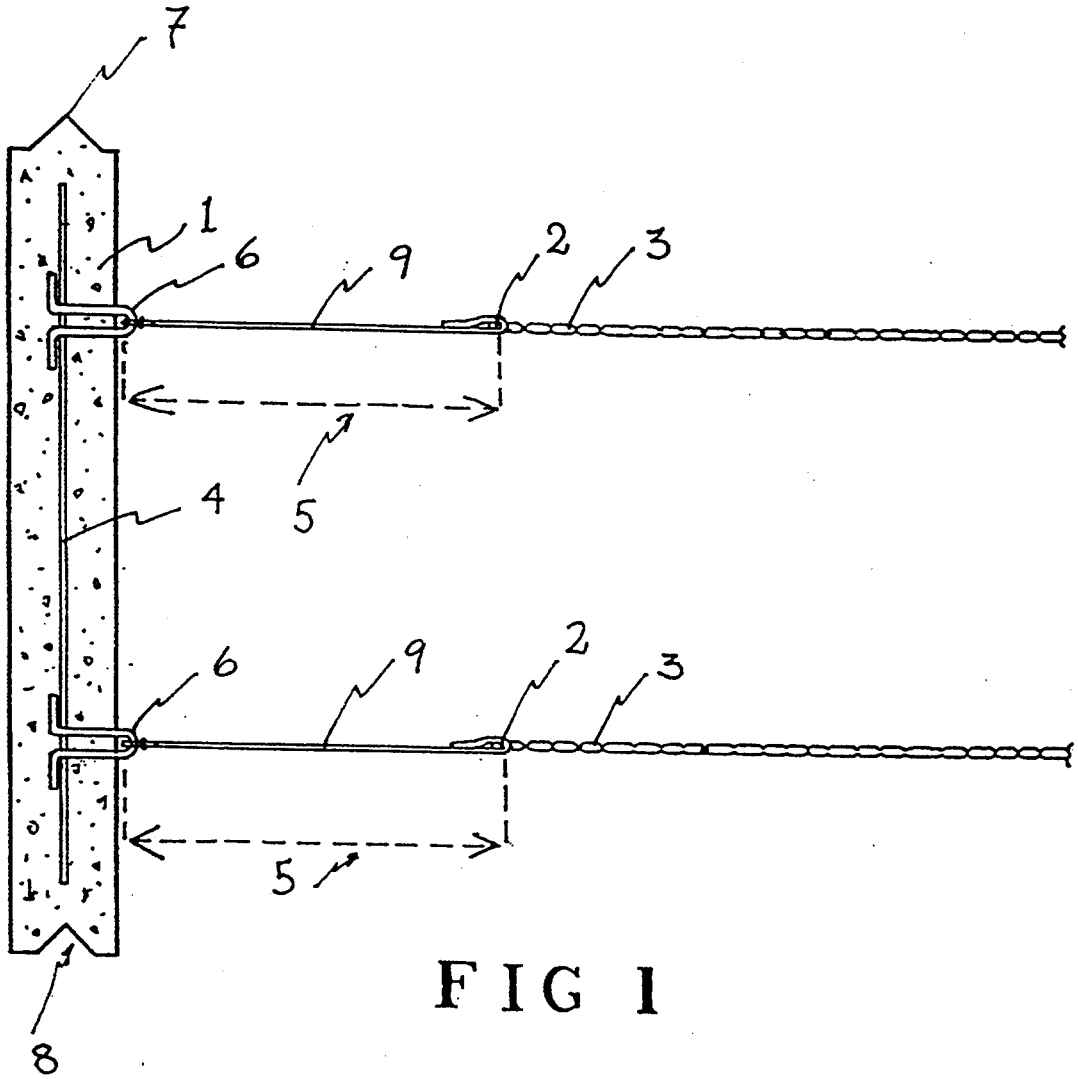
FIG. 1, shows in cross section a fragmental view of the incorporated slabs, tie rods, and mesh.
Figure 2:
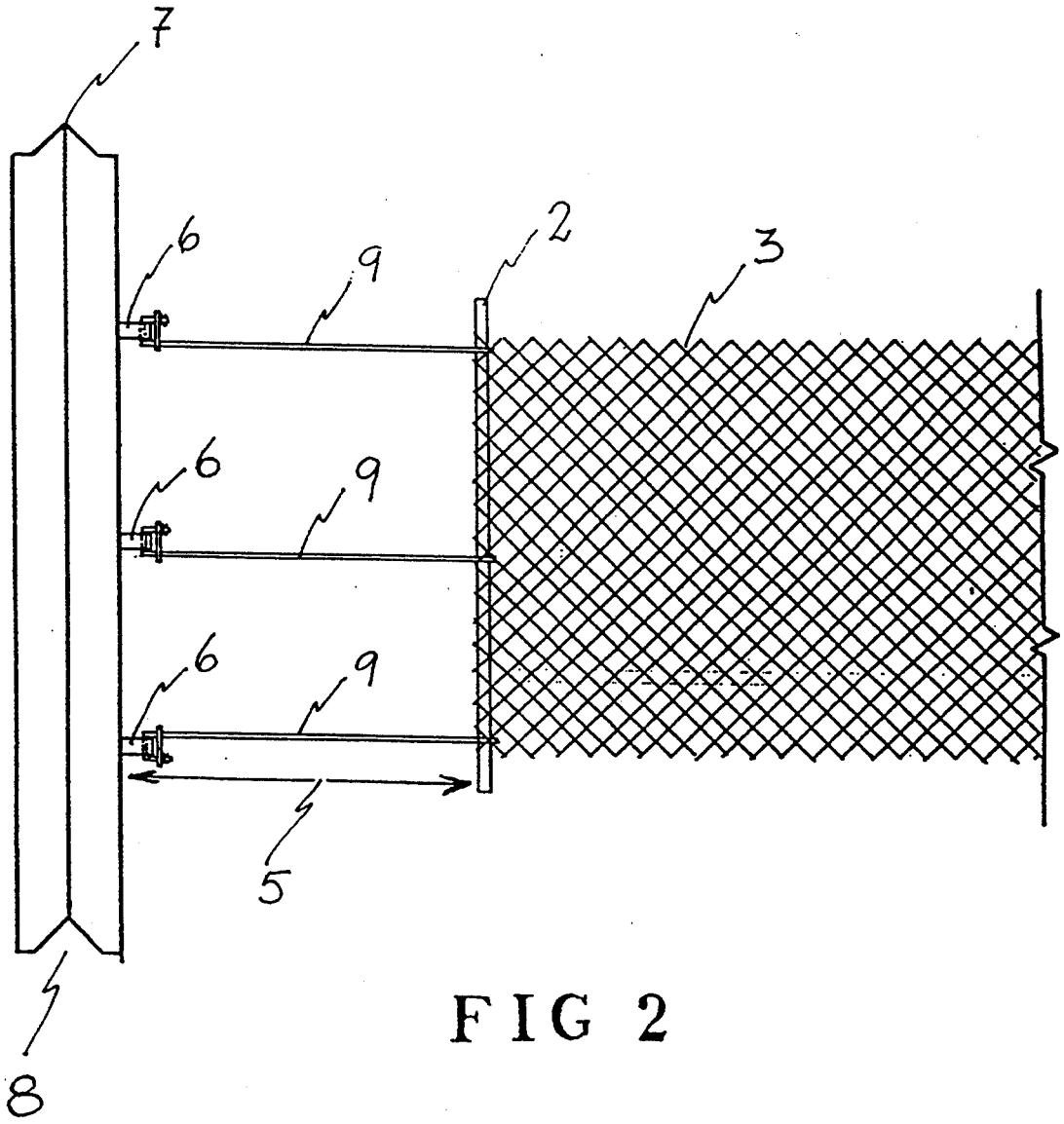
FIG. 2, shows a top fragmental view of the incorporated slabs, tie rods, and mesh.

In reference to said figures, this system comprises in combination, lateral slab (1) V-shaped edges have two female groove entries, (8) and two male entries (7) for fitting the grooves, which allow the slabs (1) to be registered axially on four sides by the insertion of the male entries (7), in the female entries (8). By forming walls with multiple slabs, it is possible to incorporate enough height to receive the necessary earth to form the required embankment. Such slabs (1) are preferably manufactured of concrete, and during pouring of the concrete one or several anchors (4) are mounted in their interior, which properly secured provide, to the omega shaped salient (6) as shown in FIG. 1 with extending loop adjacent the slab surface, the necessary strength to support the tension that the mesh's load requires.

Figure 3:
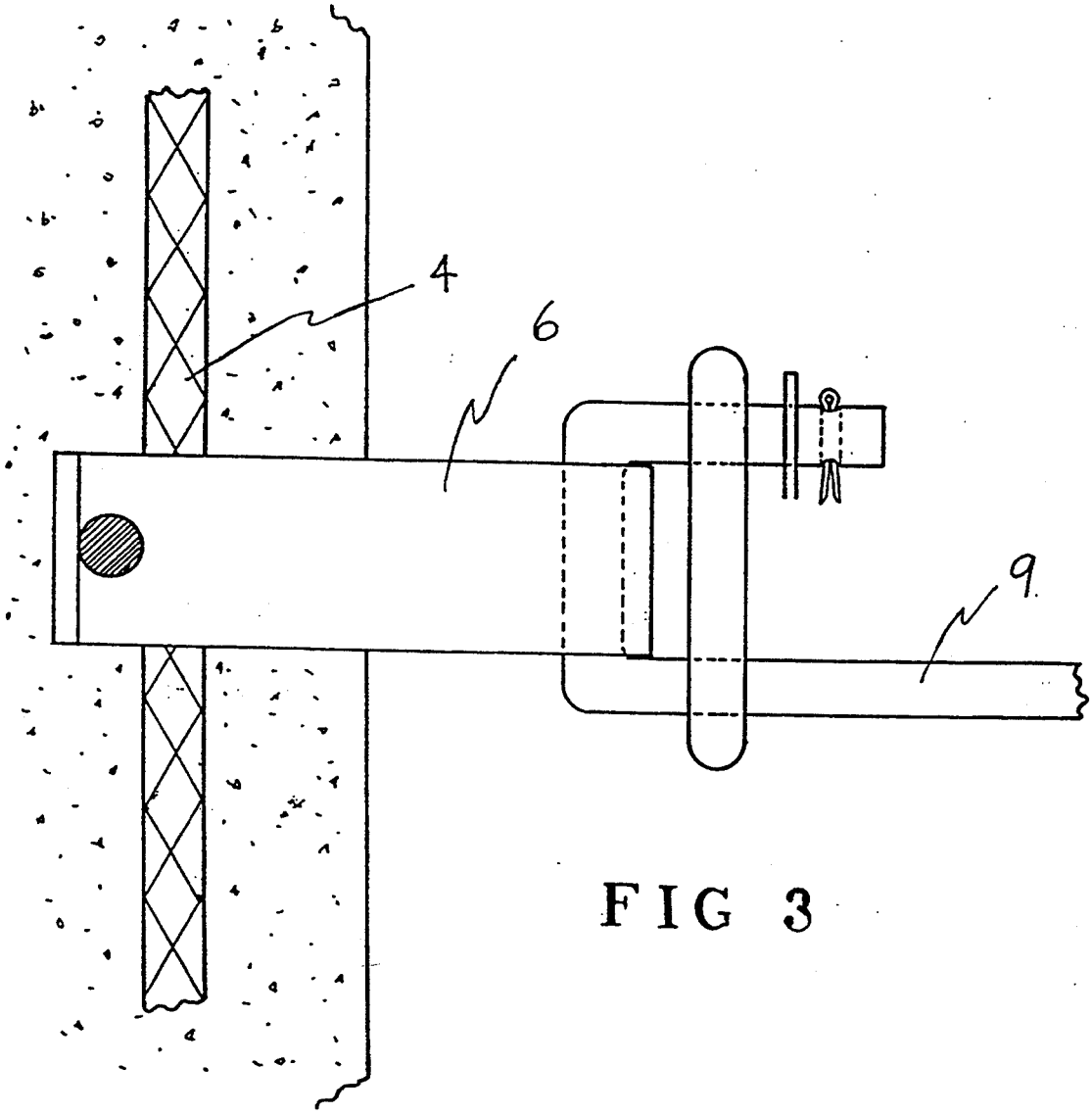
FIG. 3, shows in side cross sectional view a part of the incorporated slabs, truss and tie rods.
Figure 4:
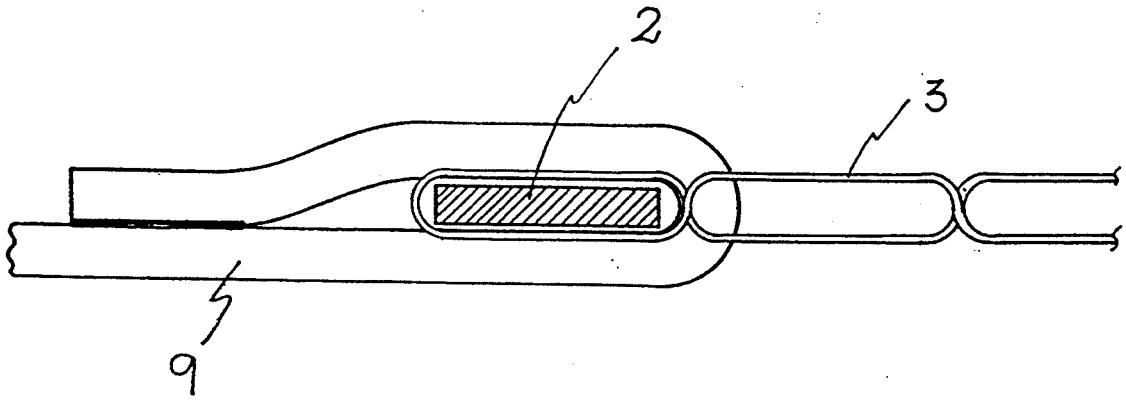
FIG. 4, shows a fragmental side view partly in section of the joint where the mesh joins the tie rod.

Also the invention combines a plurality of trusses (9) shown in the drawing as cylindrical rods, which have opposite ends hooking the salient loop (6) (FIGS. 3, 4) and holding the mesh (3) by means of the rod (2), in such a way that the mesh can maintain its position regardless of the external tensions and the internal pressures.

Of special importance, the length of the truss (9), between the mesh (3) and the slabs (1), becomes and area of overflow tolerance (5) of deposits between meshes (3) that at the moment the depositing start eliminates the possibility of deformations, loosenings or even fractures of the mesh that could happen if such area of tolerance (5) was not established to permit deposits to pass between meshes.

I claim:

1. An earth reinforcement and embankment system comprising in combination slabs (1) with interfitting V-shaped edges (7, 8) comprising mating male members and female grooves, anchor means (4) inside the slabs (1) securing a plurality of spaced apart Omega ( ) shaped salients (6) held in place before pouring, each salient exiting the slab by a salient loop extending outside the slab adjacent one surface therefor and anchored inside the slabs by engagement of the anchor means with the salients, a set of meshes (3) for coupling to the salient loops, truss rods (9) of cylindrical shape hooked to said salient loops at one end and holding one of the meshes at another end in such a way that the mesh can maintain its position regardless of external tensions and internal pressures, said truss rods being of a length between the slab and the meshes permitting deposited earth to pass between the meshes and slabs and to reside about the truss rods thereby to avoid malformation of deposited earth from damaging the meshes.

* * * * *